US010737903B2

(12) United States Patent
Poutiainen

(10) Patent No.: US 10,737,903 B2
(45) Date of Patent: Aug. 11, 2020

(54) HOSE REEL

(71) Applicant: Fiskars Finland Oy Ab, Helsinki (FI)

(72) Inventor: Vesa Poutiainen, Espoo (FI)

(73) Assignee: Fiskars Finland Oy Ab, Helsinki (FI)

( * ) Notice: Subject to any disclaimer, the term of this patent is extended or adjusted under 35 U.S.C. 154(b) by 0 days.

(21) Appl. No.: 15/974,344

(22) Filed: May 8, 2018

(65) Prior Publication Data

US 2018/0334353 A1 Nov. 22, 2018

(30) Foreign Application Priority Data

May 17, 2017 (FI) ..... 20175446

(51) Int. Cl.
*B65H 75/44* (2006.01)
*B65H 75/40* (2006.01)
*B65H 75/48* (2006.01)

(52) U.S. Cl.
CPC ..... *B65H 75/4402* (2013.01); *B65H 75/40* (2013.01); *B65H 75/4407* (2013.01); *B65H 75/4434* (2013.01); *B65H 75/4463* (2013.01); *B65H 75/4471* (2013.01); *B65H 75/4478* (2013.01); *B65H 75/48* (2013.01); *B65H 75/486* (2013.01); *B65H 2701/33* (2013.01); *Y10T 137/6958* (2015.04)

(58) Field of Classification Search
CPC ..... B65H 75/4402; B65H 75/4407; B65H 75/4463; B65H 75/4471; Y10T 137/6958
See application file for complete search history.

(56) References Cited

U.S. PATENT DOCUMENTS

| | | | |
|---|---|---|---|
| 1,746,995 | A | 2/1930 | Edwards |
| 1,982,610 | A | 11/1934 | Harris |
| 2,496,489 | A | 2/1950 | Palm |
| 2,519,064 | A | 8/1950 | Palm |
| 2,595,655 | A | 5/1952 | Hannay |

(Continued)

FOREIGN PATENT DOCUMENTS

| | | | |
|---|---|---|---|
| CN | 1211225 | A | 3/1999 |
| CN | 1359351 | A | 7/2002 |

(Continued)

OTHER PUBLICATIONS

Extended European Search Report for EP Application No. 18171165.6, dated Oct. 9, 2018, 8 pages.

(Continued)

*Primary Examiner* — Kevin F Murphy
(74) *Attorney, Agent, or Firm* — Foley & Lardner LLP

(57) ABSTRACT

A hose reel includes a frame, a reel, a rewind mechanism with a spring and a guide mechanism with a guide. The guide mechanism moves the guide back and forth on a path while the reel is rotated for distributing the hose evenly onto the reel by the guide. To obtain a freestanding hose reel with a rewind mechanism the hose reel includes a ground support with contact areas supporting the hose reel from a base. The frame is attached to the ground support in a position where the rotation axis of the reel is perpendicular relatively to the base, and the reel is provided with a hose joint in a lowermost part of the reel and the guide mechanism is configured to move the guide to a lowermost point of the path when the hose is completely pulled out from the reel.

10 Claims, 3 Drawing Sheets

(56) References Cited

U.S. PATENT DOCUMENTS

| | | | | |
|---|---|---|---|---|
| 2,742,242 | A | 4/1956 | James | |
| 3,612,094 | A | 10/1971 | Hare | |
| 4,757,838 | A * | 7/1988 | McGullion | B65H 75/38 137/355.27 |
| 5,335,687 | A | 8/1994 | Odom | |
| 6,050,290 | A * | 4/2000 | Yacobi | B65H 75/403 137/355.2 |
| 6,273,354 | B1 | 8/2001 | Kovacik et al. | |
| 6,807,982 | B1 * | 10/2004 | Ames | B65H 75/364 137/355.27 |
| 7,344,103 | B1 | 3/2008 | Eley | |
| 7,559,501 | B2 | 7/2009 | Jian | |
| 7,857,000 | B1 * | 12/2010 | Langdon | B65H 75/38 137/355.27 |
| D767,374 | S | 9/2016 | Vanttila et al. | |
| D787,921 | S | 5/2017 | Vanttila et al. | |
| D792,756 | S | 7/2017 | Vanttila et al. | |
| 2004/0163710 | A1 | 8/2004 | Kovacik et al. | |
| 2009/0189005 | A1 | 7/2009 | Roman et al. | |
| 2010/0294897 | A1 | 11/2010 | Georgey | |
| 2013/0168482 | A1 | 7/2013 | Moore | |
| 2014/0151527 | A1 * | 6/2014 | Sawhney | F16M 11/242 248/542 |
| 2017/0107076 | A1 | 4/2017 | Barnes | |

FOREIGN PATENT DOCUMENTS

| | | | |
|---|---|---|---|
| CN | 2685299 | Y | 3/2005 |
| CN | 201626742 | U | 11/2010 |
| CN | 102612479 | A | 7/2012 |
| CN | 202744115 | U | 2/2013 |
| CN | 203187238 | U | 9/2013 |
| CN | 203246975 | U | 10/2013 |
| CN | 103456285 | A | 12/2013 |
| CN | 203333088 | U | 12/2013 |
| CN | 203450969 | U | 2/2014 |
| CN | 105731194 | A | 7/2016 |
| CN | 205590095 | U | 9/2016 |
| CN | 205675917 | U | 11/2016 |
| CN | 205953226 | U | 2/2017 |
| DE | 20 2013 100 598 | U1 | 4/2013 |
| EP | 0 493 736 | A2 | 7/1992 |
| FI | 10179 | U1 | 8/2013 |
| FI | 10903 | U1 | 6/2015 |
| GB | 1 299 162 | A | 12/1972 |
| WO | WO-99/06316 | A1 | 2/1999 |
| WO | WO-99/41183 | | 8/1999 |
| WO | WO-2011/059710 | A1 | 5/2011 |

OTHER PUBLICATIONS

U.S. Appl. No. 29/576,789, filed Sep. 7, 2016, Lyytikainen et al.
U.S. Appl. No. 29/626,067, filed Nov. 14, 2017, Lyytikainen et al.
Search Report for Finnish Application No. 20175446, dated Dec. 8, 2017, 2 pages.
Search Report for Finnish Application No. 20175447, dated Dec. 8, 2017, 2 pages.
Office Action Received for Canadian Application No. 3,004,103, dated Mar. 8, 2019, 4 pages.
Office Action Received for Canadian Application No. 3,004,108, dated Mar. 19, 2019, 3 pages.
English Translation of Search Report for Chinese Application No. 201810471042.1, dated Aug. 2, 2019, 7 pages.
English Translation of Search Report for Chinese Application No. 201810471093.4, dated Aug. 6, 2019, 9 pages.

* cited by examiner

HOSE REEL

CROSS-REFERENCE TO RELATED APPLICATION

This application claims the benefit of and priority to Finland Application No. 20175446, filed May 17, 2017, the content of which is hereby incorporated by reference in its entirety.

BACKGROUND OF THE INVENTION

Field of the Invention

This invention relates to hose reel for a garden hose, for instance. In particular, the invention relates to a freestanding hose reel with an automatic rewind mechanism.

Description of Prior Art

Previously there is known a hose reel with a frame having a reel rotatably arranged within the frame. In this hose reel a rewind mechanism with a spring is utilized for rewinding a hose to the reel once a user has stopped using the hose. Additionally, this known hose reel is provided with a guide mechanism moving a guide back and forth during rewinding in order to distribute the hose evenly onto the reel during rewinding.

With an automatic hose reel of this type, in other words a reel having a rewind mechanism with a spring, a user needs to pull out the hose from the reel with a force which is not only sufficiently large to cause the reel to rotate, but additionally, the used force needs to tension the spring. Therefore the used force needs to be larger than what is sufficient for non-automatic hose reels which do not have a similar rewind mechanism with a spring.

Due to the need to use a relatively large force to pull out the hose, this known hose reel is provided with a wall mounting bracket facilitating attachment of the hose reel to a wall of a house, for instance, in a position where the rotating axis of the reel is horizontal.

A wall mounted hose reel is, however, not optimal in all situations, because the wall mounting prevents the user from easily moving the hose reel to an other location where the hose is needed. The hose may, for instance, be too short for facilitating use of the hose at a location on the back side of a house while the hose reel is attached to a wall on a front side of a house, for instance.

SUMMARY OF THE INVENTION

An object of the present invention is to solve the above mentioned drawback and to provide a hose reel which is stable enough to be used as a free standing hose reel with a rewind mechanism. This object is achieved with the hose reel according to independent claim 1.

In a hose reel having a rewind mechanism with a spring, the force needed to pull out the hose reaches a maximum level once the hose is completely pulled out from the reel and the spring consequently is maximally tensioned. In this moment the stability of the hose reel depends on the location of a contact point between the hose and the reel. A sufficient stability can be achieved when the hose joint of the hose reel is arranged in a lowermost part of a reel having a rotation axis that is perpendicular to the base, and when the guide guiding out the hose from the reel at this stage is located as low as possible. With such a solution the contact point between the hose and the reel is in praxis located as low as possible.

Preferred embodiments of the hose reel are disclosed in the dependent claims.

BRIEF DESCRIPTION OF DRAWINGS

In the following the hose reel will be described in closer detail by way of example and with reference to the attached drawings, in which.

DESCRIPTION OF AT LEAST ONE EMBODIMENT

Figure 1:
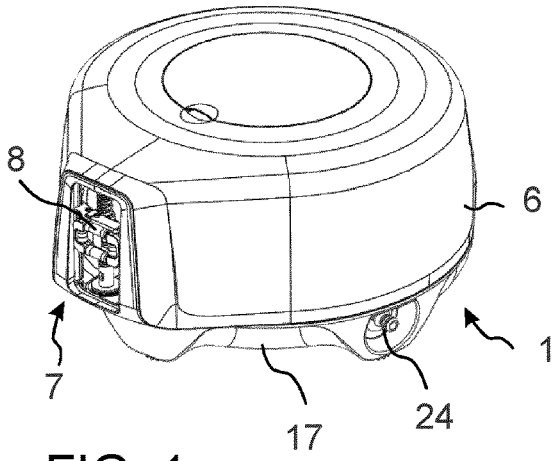
FIGS. 1 and 2 illustrate a first embodiment of a hose reel.
Figure 2:
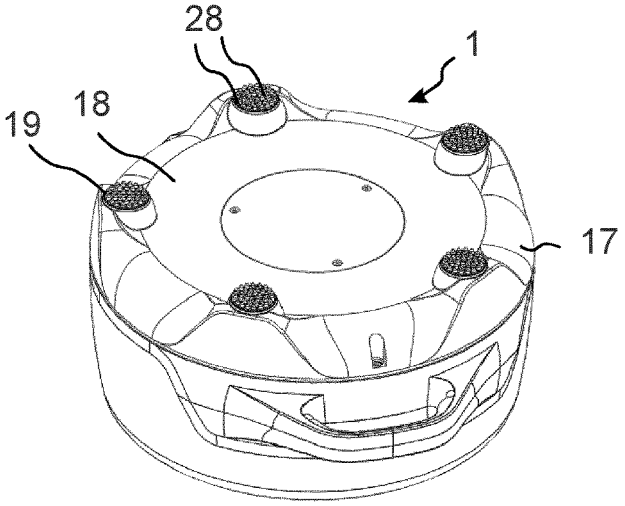
Figure 3:
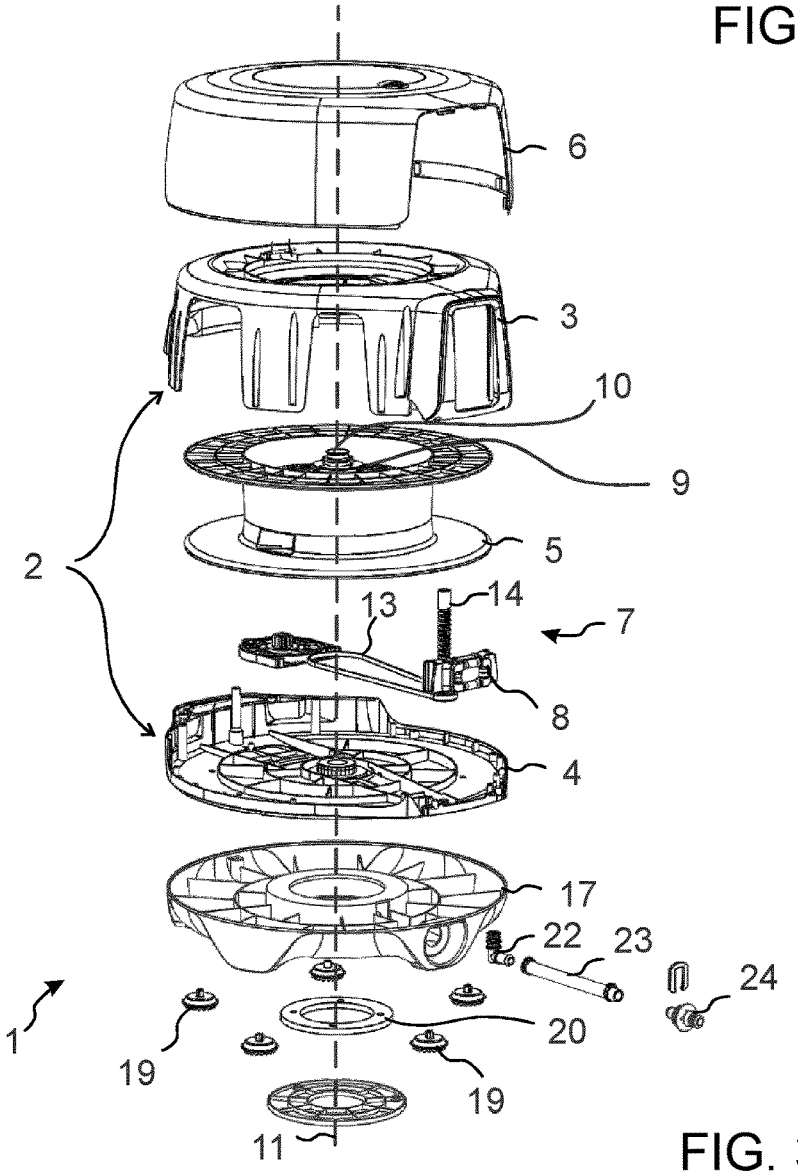
FIG. 3 is an exploded view of the hose reel in FIGS. 1 and 2.

FIG. 1 illustrates a hose reel 1 from above, FIG. 2 illustrates the bottom part of the hose reel 1, and FIG. 3 illustrates an exploded view of the hose reel.

The hose reel comprises a frame 2 which in this example comprises an upper frame part 3 and a lower frame part 4 attached to each other. A reel 5 is rotatably arranged within the frame 2. In order to obtain a hose reel which stands stable on a base, such as outdoors on the ground, the hose reel is provided with a reel rotating around a rotation axis which is perpendicular to the base. With such a horizontally oriented reel that rotates around a vertical axis the center of gravity of the entire hose reel is located as low as possible, which improves stability.

In the illustrated embodiment, the hose reel 1 is additionally provided with an upper lid 6, which is attached to the frame 2. This upper lid 6 has solid, non-perforated outer and side surfaces preventing the fingers of a user from coming into contact with the rotating reel 5, which may be dangerous and seriously injure the user. In order to provide efficient protection the lid 6 is provided with an opening only at a front side where a guide mechanism 7 with a guide 8 is arranged in order to guide a hose to an outside of the hose reel 1.

The illustrated hose reel 1 is of an automatic type, which refers to a hose reel 1 having a rewind mechanism with a spring 9. A first end of the spring 9 is attached to the reel 5 and a second end to a vertical axle 10 having an upper end which during use of the hose reel 1 is non-rotatably attached to the frame 2 or lid 6. Consequently, when the reel is rotated within the frame 1 in a first direction around a rotation axis 11 while a hose 12 is pulled out from the reel 5, the spring 9 is tensioned as the vertical axle 10 does not rotate with the reel. Subsequently, once the use of the hose 12 ends, the spring force of the spring 9 rotates the reel 5 in a second direction within the frame such that the hose 12 is re-winded to the reel 5.

Preferably the hose reel 1 is provided with a lock mechanism preventing the rewind mechanism from rewinding the hose while the user utilizes the hose. Once the user has finished using the hose, the user may pull the hose once to release the break such that the rewind mechanism may start rewinding the hose to the reel. Additionally, in order to prevent the rewinding from occurring with a speed that is too high, a break is preferably provided in order to limit the rewinding speed. Such a lock and break may be implemented as in prior art solutions and are therefore not illustrated in detail.

Figure 4:
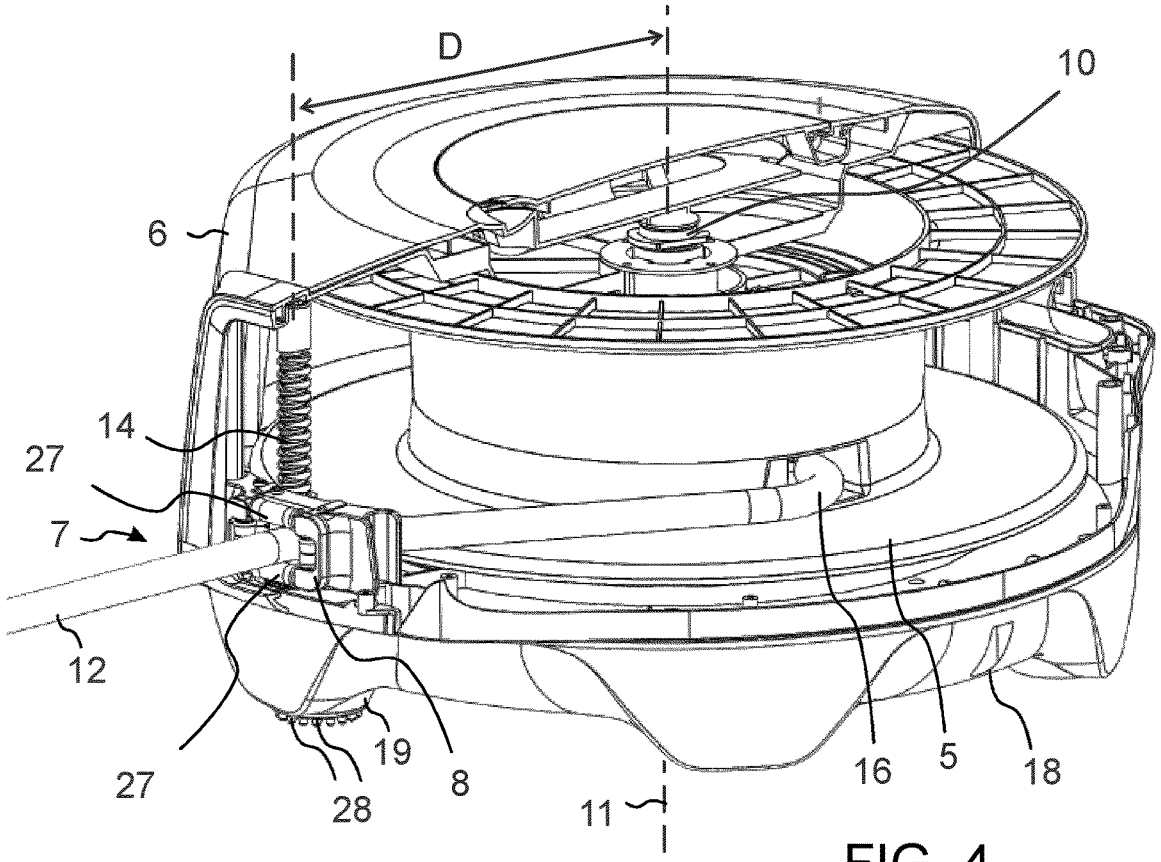
FIG. 4 illustrates the hose attachment to the hose reel of FIGS. 1 and 2.
Figure 5:
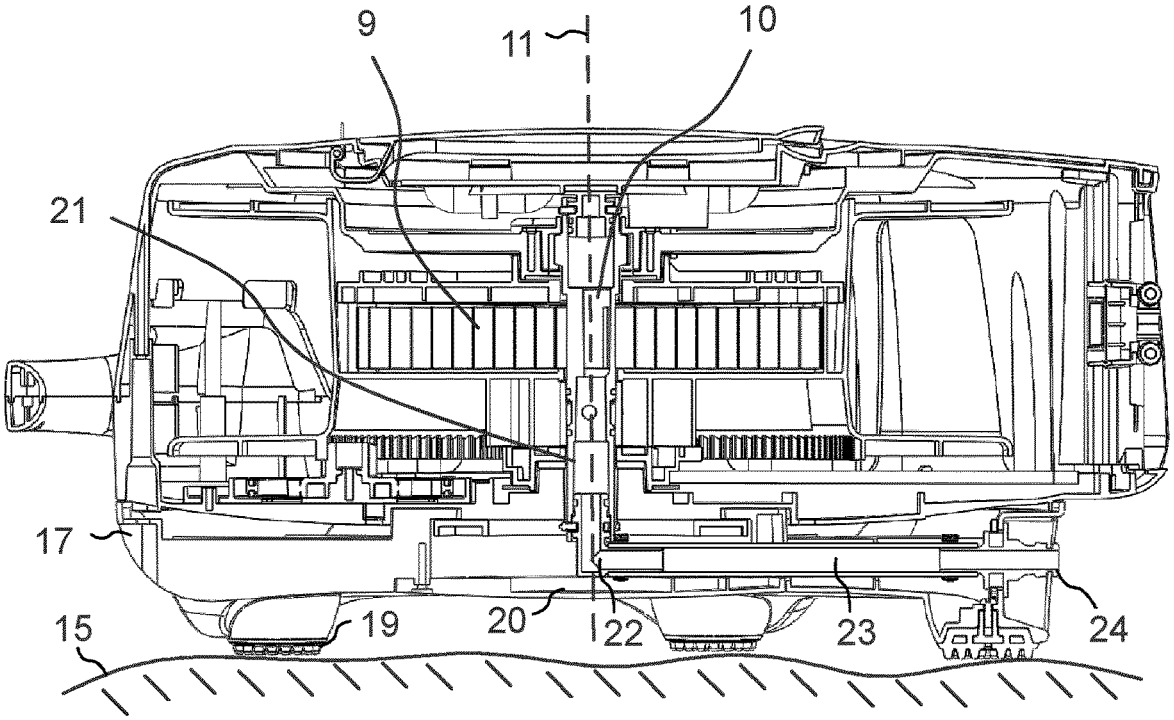
FIG. 5 illustrates a cross-section of the hose reel of FIGS. 1 and 2.

FIG. 4 illustrates the hose attachment to the hose reel 1 and FIG. 5 illustrates a cross-section of the hose reel 1 of FIGS. 1 and 2.

The guide mechanism 7 of the hose reel 1 moves the guide 8 back and forth on a path while the reel 5 rotates. In the illustrated example a belt 13 is utilized for causing a screw 14 to rotate. The threads on the screw 14 and on the guide 8 are shaped such that once the guide 8 reaches the upper or lower end of the screw, the guide changes direction and starts to move in the opposite direction even though the screw 14 continues to rotate in the same direction as previously. Due to this the hose 12 is distributed evenly onto the reel 5 in several layers while it is being re-winded.

When the hose 12 is fully pulled out from the reel 5 and there is no more hose to pull out from the reel 5, the force needed to pull out the hose reaches its maximum level. This situation is illustrated in FIG. 4. In order to ensure that the hose reel 1 remains as stable as possible in this situation the hose reel 1 is designed in such a way that at this moment the hose 12 comes out from the hose reel at the lowest possible level. In case of a hose reel 1 with a reel that rotates around a rotation axis 11 of the reel 5 that is perpendicular relatively to the base 15, this means that the hose 5 should come out from the reel as close to the ground support 17 and base 15, in praxis the ground, as possible. This is achieved when the hose joint 16, via which fluid is provided to the hose 12, is located in the lowermost part of the reel 5. Additionally, as illustrated in FIG. 4, the guide mechanism 7 is configured to move the guide 8 to a lowermost point of the path along which the guide moves, when the hose is completely pulled out from the hose reel. In this way, the force caused by pulling the hose affects the hose reel 1 as low as possible, which helps to improve the stability of the hose reel and preventing it from tipping over.

In horizontal reeling there is risk that the different layers of the hose 12 do not wind up evenly on the hose layer, as gravity attempts to move a part of the hose sideways towards the ground. In such a situation, when the hose is pulled out, there is a risk of jamming. Such jamming affects the stability of the hose reel when it occurs. In the illustrated hose reel 12 the distance D between the rotation axis 11 and the guide 8 has been maximized by locating the guide 8 in a part of the frame 2 which is as far away as possible from the rotation axis 11. In this way the hose can always be pulled out from the reel in an angle which is as optimal (small) as possible, also when a part of the hose has moved sideways towards the ground. Additionally, the guide 8 comprises a plurality of rotatably arranged rolls 27 enclosing an exit opening for the hose 12 from the hose reel 1. This lowers the friction between the guide 8 and the hose 12 when the hose moves in relation to the guide.

In order to make the hose reel 1 as easy to use as possible, the hose reel 1 is provided with a ground support 17 with a bottom surface 18 that is provided with contact areas 19 for supporting the hose reel from the base 15. In the illustrated example the ground support 17 is attached to the lower part 4 of the frame by a ring shaped plate 20 and screws, for instance. These screws extend from below through the ring shaped plate 20 and a hole in the ground support and engage the lower part 4 of the frame. With such an attachment the ground support 17 is in praxis rotatably clamped between the lower part 4 of the frame and the ring shaped plate 20. This allows the frame 4 of the hose reel 1 to rotate in relation to the ground support 17. Such an attachment between the frame 2 and the ground support 17 facilitates that the frame 2 can rotate more than 360° (limitless) in relation to the ground support 17. This is an advantage in a free standing hose reel located on the ground, for instance, as the frame 2 in that case always automatically rotates into a position where the guide 8 is directed towards the user when the user pulls out the hose from the hose reel. In this position, once the user stops using the hose, the guide of the hose reel is directly in an optimal position for rewinding the hose to the reel. Additionally, once the user stops using the hose and the spring force of the spring rewinds the hose to the reel until a stopper on the outer end of the hose comes into contact with the guide 8, the rewinding of the hose ends abruptly, as the stopper hits the guide 8. With the illustrated design the frame 4 is caused to rotate slightly in relation to the ground support 17 due to this hit. Such rotation dampens the forces caused by the hit and helps to prevent damage to parts of the hose reel.

The contact areas 19 on the bottom surface 18 of the ground support 17 are implemented to have a plurality of protrusions 28 of an elastic material. One alternative is to provide the contact areas 19 with protrusions 28 of a rubber material, for instance. This increases the friction on a hard surface like stone and asphalt. The small protrusion or studs in the contact areas 19 enables friction contact to penetrate to the ground even if there are small round particles like small stones under them. Such a solution efficiently helps to ensure that the hose reel 1 remains steadily on the location where the user has placed the hose reel even during pulling out of the hose.

In praxis three contact areas 19 on the bottom surface 18 of the ground support 17 is sufficient to keep the hose reel standing steadily on the base 15. However, due to the fact that the frame 2 rotates in relation to the ground support, the force caused by pulling the hose may affect the hose reel from any direction. Therefore the number of contact areas 19 is preferably larger that three. In practice a very steady hose reel can be obtained by utilizing five contact areas 19 which are evenly distributed on a circle on the bottom surface 18, for instance.

In order to provide fluid (usually water) to the hose 12, a flow channel 21 is provided along the rotation axis 11 to extend from the hose joint 16 to a first end of a feed joint 22 provided in the ground support 17. The feed joint 22 is shaped with a 90° corner such that the second end of the feed joint 22 is attached to a generally horizontally extending flexible hose 23. An outer end of the flexible hose 23, which extends along the generally planar base 15, is connected to an external hose joint 24. An end of a feeding hose can be connected to this external hose joint 24 in order to provide a fluid flow from a fluid source to the hose reel 1 via this external hose joint.

An advantage in utilizing a flexible hose 23 instead of a stiff tube, for instance, between the feed joint 22 and the external hose joint 24 is that a floating flow channel 21 can be obtained where any forces directed towards the external hose joint 24, for instance, are prevented from affecting the feed joint 22 or the flow channel 21. Due to this sideways bending of the feed joint 22 and the flow channel 21 can be avoided, which helps to ensure that the connections of the flow channel remain fluid tight.

As previously described, the ground support 17 is rotatably clamped between the lover frame part 4 and ring shaped plate 20 by screws, while the supply of fluid to the hose 12 is provided via the flow channel 21, the feed joint 22 and the flexible hose 23. Consequently any forces which are directed from the frame 2 to the ground support 17, or vice versa, are handled by the mechanical attachment involving the ring shaped plate, the frame part and screws, and to therefore not affect the parts providing the fluid flow to the hose 12. This efficiently prevents leaks on the fluid path.

Figure 6:
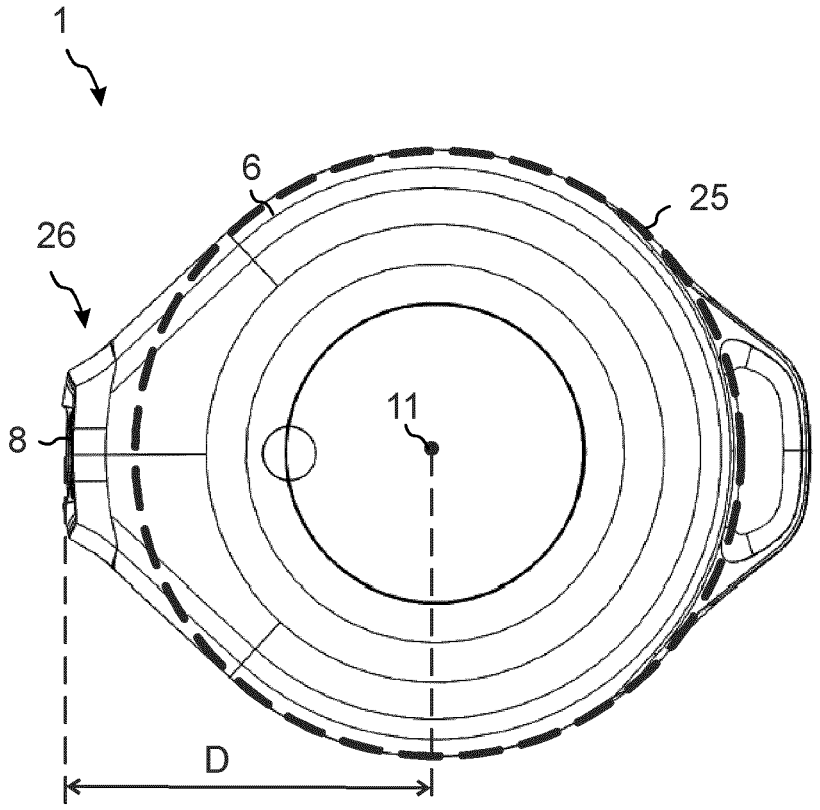
FIG. 6 illustrates the hose reel of FIGS. 1 and 2 from above.

FIG. 6 illustrates the hose reel of FIGS. 1 and 2 from above. The frame 2 which in this viewing angle is covered by the upper lid 6 has a generally circular shape 25 when viewed in the direction of the rotation axis 11. In the left part of FIG. 6 the frame is provided with a protruding part 26 and the guide 8 is arranged in this protruding part 26. In this way the distance D from the rotation axis 11 to the guide can be maximized. This lowers the friction when pulling out the hose from the hose reel and minimizes the risk of jamming.

It is to be understood that the above description and the accompanying figures are only intended to illustrate the present invention. It will be obvious to a person skilled in the art that the invention can be varied and modified without departing from the scope of the invention.

The invention claimed is:

1. A hose reel, comprising:

a frame, a reel rotatably arranged within the frame, a rewind mechanism with a spring which is tensioned when the reel is rotated within the frame in a first direction around a rotation axis while a hose is pulled out from the reel, and which provides the reel with a spring force rotating the reel in a second direction within the frame to rewind the hose to the reel, a guide mechanism with a guide via which the hose is guided to an outside of the hose reel, the guide mechanism moving the guide back and forth on a path while the reel is rotated in the second direction for distributing the hose evenly onto the reel by means of the guide, and a ground support with contact areas supporting the hose reel from a base in a position where the rotation axis of the reel is perpendicular relative to the base, and wherein the ground support is clamped between a lower part of the frame and a plate, said clamping allowing the frame and the plate to rotate in relation to the ground support, wherein the reel is provided with a hose joint in a lowermost part of the reel to guide out the hose from the reel at a location as low and as close to the base as possible, and the guide mechanism is configured to move the guide to a lowermost point of the path when the hose is completely pulled out from the reel.

2. The hose reel according to claim 1, wherein the guide comprises a plurality of rotatably arranged rolls enclosing an exit opening for the hose from the hose reel.

3. The hose reel according to claim 1, wherein the frame has a generally circular shape when viewed in the direction of the rotation axis and at least one protruding part to which the guide is arranged for maximizing a distance (D) from the rotation axis to the guide.

4. The hose reel according to claim 1, wherein the guide is arranged in a part of the frame which is located as far as possible from the rotation axis.

5. The hose reel according to claim 1, wherein the contact areas are provided with a plurality of protrusions of an elastic material.

6. The hose reel according to claim 1, wherein the ground support is provided with at least five contact areas which are evenly distributed along a circle having its center point at the location of the rotation axis.

7. The hose reel according to claim 1, wherein the frame comprises an upper lid which together with the frame encloses the reel substantially from all directions and prevents contact between a user of the hose reel and the reel.

8. The hose reel according to claim 1, wherein frame is rotatably attached to the ground support such that the frame can rotate more than 360° in relation to the ground support.

9. The hose reel according to claim 1, wherein a flow channel is provided along the rotation axis to extend from the hose joint to a first end of a feed joint provided in the ground support, a second end of the feed joint is attached to a flexible hose extending along the base to an external hose joint which is provided in a side surface of the ground support to receive a fluid flow.

10. A hose reel, comprising:

a frame, a reel rotatably arranged within the frame, a rewind mechanism with a spring which is tensioned when the reel is rotated within the frame in a first direction around a rotation axis while a hose is pulled out from the reel, and which provides the reel with a spring force rotating the reel in a second direction within the frame to rewind the hose to the reel, a guide mechanism with a guide via which the hose is guided to an outside of the hose reel, the guide mechanism moving the guide back and forth on a path while the reel is rotated in the second direction for distributing the hose evenly onto the reel by means of the guide, and a ground support with contact areas supporting the hose reel from a base in a position where the rotation axis of the reel is perpendicular relative to the base, and wherein the ground support is rotatably clamped between a lower part of the frame and a plate with screws, wherein the screws extend from below through the plate and a hole in the ground support and engage the lower part of the frame allowing the frame and the plate to rotate in relation to the ground support, wherein the reel is provided with a hose joint in a lowermost part of the reel to guide out the hose from the reel at a location as low and as close to the base as possible, and the guide mechanism is configured to move the guide to a lowermost point of the path when the hose is completely pulled out from the reel.

* * * * *